US011619102B2

(12) United States Patent
Selvam

(10) Patent No.: US 11,619,102 B2
(45) Date of Patent: Apr. 4, 2023

(54) TORQUE WRENCH ENGAGEMENT MECHANISM

(71) Applicant: Caterpillar Global Mining Equipment LLC, Denison, TX (US)

(72) Inventor: Sudhagar Selvam, Chennai (IN)

(73) Assignee: Caterpillar Global Mining Equipment LLC, Denison, TX (US)

( * ) Notice: Subject to any disclaimer, the term of this patent is extended or adjusted under 35 U.S.C. 154(b) by 635 days.

(21) Appl. No.: 16/697,113

(22) Filed: Nov. 26, 2019

(65) Prior Publication Data

US 2021/0156208 A1 May 27, 2021

(51) Int. Cl.
*E21B 19/16* (2006.01)

(52) U.S. Cl.
CPC ..... *E21B 19/161* (2013.01)

(58) Field of Classification Search
CPC ..... E21B 19/161
USPC ..... 81/90.4
See application file for complete search history.

(56) References Cited

U.S. PATENT DOCUMENTS 3,021,739 A * 2/1962 Grundmann ..... E21B 19/164 81/57.35
3,380,324 A 4/1968 Hillman
4,102,414 A * 7/1978 Bailey ..... E21B 19/167 175/85
5,542,318 A * 8/1996 Wesch, Jr. ..... E21B 19/161 81/57.2
5,664,606 A 9/1997 Anderson
6,050,156 A 4/2000 Buck
6,138,529 A * 10/2000 Pietras ..... E21B 19/161 81/57.33
7,000,502 B2 2/2006 Belik
7,117,938 B2 10/2006 Hamilton et al.
8,733,213 B2 5/2014 Taggart

FOREIGN PATENT DOCUMENTS

CN 201344005 11/2009
CN 205955669 2/2017

* cited by examiner

*Primary Examiner* — Hadi Shakeri

(57) ABSTRACT

A torque wrench engagement mechanism for a drilling machine is provided. The torque wrench engagement mechanism includes a wrench assembly. The wrench assembly includes a wrench member having a receiving portion adapted to receive a flattened portion of a pipe. The wrench assembly includes a guide member disposed adjacent to the wrench member. The wrench assembly also includes at least one guide pin disposed between the wrench member and the guide member. The wrench assembly further includes a spring member disposed in association with the at least one guide pin. The torque wrench engagement mechanism also includes an actuation member operably coupled to the wrench assembly. At an extended position of the actuation member, the spring member is adapted to move the wrench member to engage with the flattened portion of the pipe, when the flattened portion of the pipe slidably aligns with the receiving portion of the wrench member.

20 Claims, 9 Drawing Sheets

TORQUE WRENCH ENGAGEMENT MECHANISM

TECHNICAL FIELD

The present disclosure relates to a torque wrench engagement mechanism. More particularly, the present disclosure relates to the torque wrench engagement mechanism for a drilling machine, such as a blasthole type drilling machine.

BACKGROUND

A drilling machine, such as a blasthole type drilling machine, includes a torque wrench assembly (henceforth referred to as the "wrench assembly") for gripping a pipe during removal or coupling of the pipe to a drill string. In many situations, the pipe includes a flattened portion adapted to engage with the wrench assembly. As such, an operator of the drilling machine may have to align the flattened portion of the pipe with the wrench assembly before operating the wrench assembly to engage with the pipe. In many situations, the alignment of the flattened portion of the pipe with the wrench assembly may be a laborious and time intensive process.

For example, limited visibility of the wrench assembly or the flattened portion of the pipe to the operator may result in increased process time, increased operator fatigue, increased operator dependence, increased operator skill, increased potential of misalignment of the wrench assembly with the flattened portion of the pipe, and so on. Further, misalignment of the wrench assembly with the flattened portion of the pipe may result in damage to the wrench assembly and/or the pipe. Hence, there is a need for an improved wrench assembly for such applications.

Chinese Patent Number 201344005 describes an automatic clamping device for a drill rod. The automatic clamping device includes a pedestal, a clamping wrench, and a clamping cylinder. A drill rod hole is provided at a center of the pedestal. Two guide rails are provided at symmetrical positions at two sides of the drill rod hole. One end of the clamping cylinder is mounted on the clamping wrench and other end is mounted on the pedestal. The clamping wrench faces the drill rod hole and moves on the two guide rails.

SUMMARY OF THE DISCLOSURE

In an aspect of the present disclosure, a torque wrench engagement mechanism is provided. The torque wrench engagement mechanism includes a wrench assembly. The wrench assembly includes a wrench member defining a central axis. The wrench member includes a receiving portion adapted to receive a flattened portion of a pipe. The wrench assembly includes a guide member disposed adjacent to the wrench member and axially aligned relative to the central axis. The wrench assembly also includes at least one guide pin disposed between the wrench member and the guide member. The wrench assembly further includes a spring member disposed in association with the at least one guide pin and between the wrench member and the guide member. The torque wrench engagement mechanism also includes an actuation member operably coupled to the wrench assembly. The actuation member is adapted to move between a retracted position, an intermediate position, and an extended position along the central axis. At the extended position, the spring member is adapted to move the wrench member to engage with the flattened portion of the pipe, when the flattened portion of the pipe slidably aligns with the receiving portion of the wrench member.

In another aspect of the present disclosure, a drilling machine is provided. The drilling machine includes a chassis, a set of ground engaging members operably coupled to the chassis, and a drill mast disposed on the chassis. The drilling machine also includes a deck frame disposed on the chassis and in association with the drill mast. The drilling machine further includes a torque wrench engagement mechanism disposed on the deck frame. The torque wrench engagement mechanism includes a wrench assembly. The wrench assembly includes wrench member defining a central axis. The wrench member includes a receiving portion adapted to receive a flattened portion of a pipe. The wrench assembly includes a guide member disposed adjacent to the wrench member and axially aligned relative to the central axis. The wrench assembly also includes at least one guide pin disposed between the wrench member and the guide member. The wrench assembly further includes a spring member disposed in association with the at least one guide pin and between the wrench member and the guide member. The torque wrench engagement mechanism also includes an actuation member operably coupled to the wrench assembly. The actuation member is adapted to move between a retracted position, an intermediate position, and an extended position along the central axis. At the extended position, the spring member is adapted to move the wrench member to engage with the flattened portion of the pipe, when the flattened portion of the pipe slidably aligns with the receiving portion of the wrench member.

In yet another aspect of the present disclosure, a method for engaging a pipe using a torque wrench engagement mechanism is provided. The method includes aligning the pipe adjacent to a wrench member of the torque wrench engagement mechanism. The method includes actuating an actuation member in an intermediate position from a retracted position along a central axis. The method includes slidably moving each of the wrench member and a guide member in a first position along the central axis. The method includes contacting an edge of the wrench member with the pipe. The method includes actuating the actuation member in an extended position from the intermediate position along the central axis. The method includes slidably moving the guide member in a second position along at least one guide pin along the central axis. The method also includes slidably moving the wrench member in a second position along the central axis based on rotation of the pipe. The method further includes receiving a flattened portion of the pipe in a receiving portion of the wrench member based on rotation of the pipe.

Other features and aspects of this disclosure will be apparent from the following description and the accompanying drawings.

DETAILED DESCRIPTION

Figures 1A, 1B:
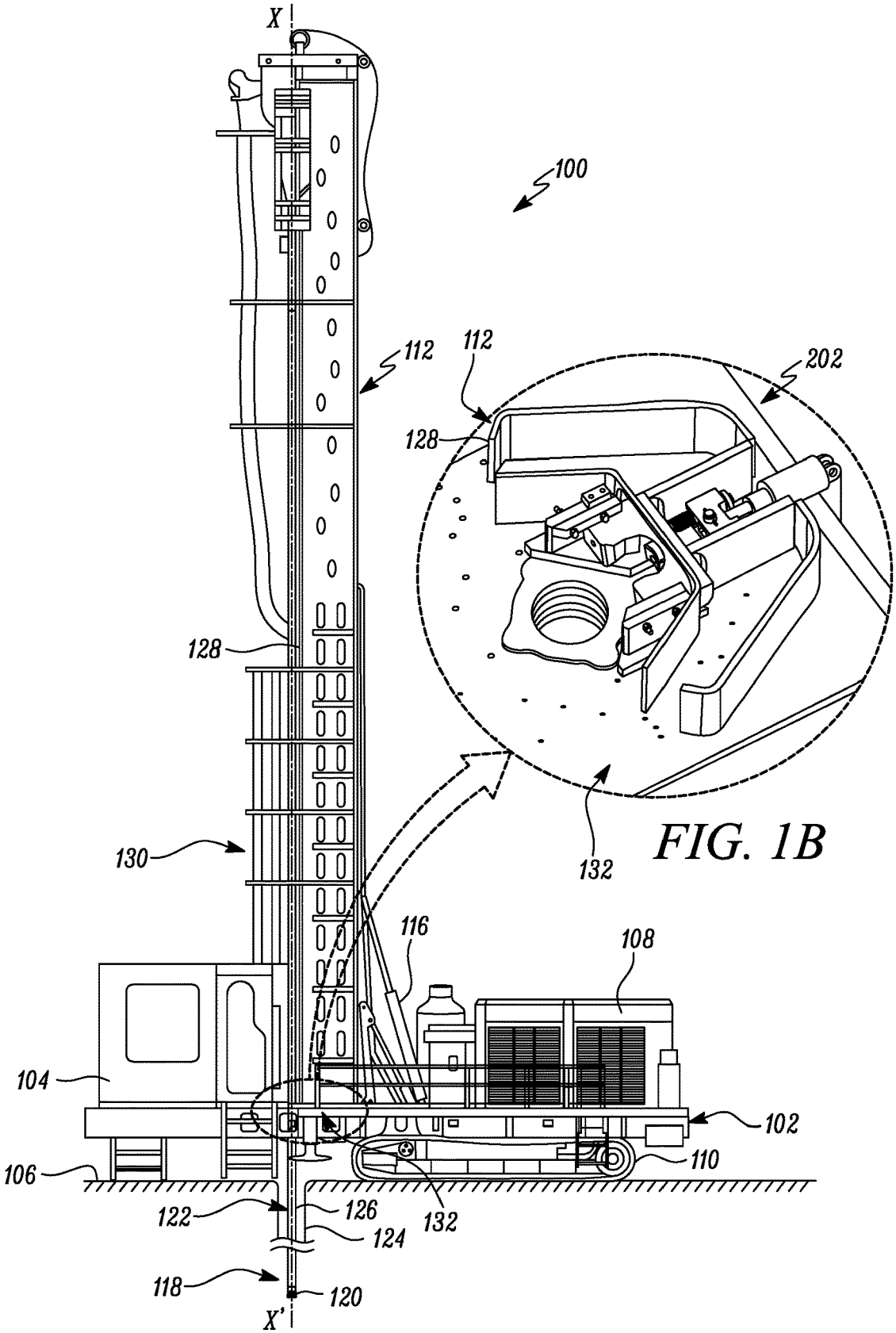
FIG. 1A is a side view of an exemplary drilling machine, according to one embodiment of the present disclosure.
FIG. 1B is a perspective view of a portion of the drilling machine showing a torque wrench engagement mechanism, according to one embodiment of the present disclosure

Wherever possible, the same reference numbers will be used throughout the drawings to refer to the same or like parts. Referring to FIG. 1A, a side view of an exemplary drilling machine 100 is illustrated. The drilling machine 100 will be hereinafter interchangeably referred to as the "machine 100". In the illustrated embodiment, the machine 100 is a rotary blasthole type drilling machine. In other embodiments, the machine 100 may be any other drilling machine, such as a surface drilling machine, a boom mounted drilling machine, and so on, based on application requirements. The machine 100 performs various drilling related operations, such as sub-surface mineral extraction; mineral exploration; environmental exploration; hydraulic fracturing; oil, gas, and/or water extraction wells; rock cut drilling for mining and/or quarrying operations; and so on, based on application requirements.

The machine 100 includes a chassis 102. The chassis 102 supports one or more components of the machine 100 thereon. The machine 100 also includes an operator cabin 104 mounted on the chassis 102. The operator cabin 104 may include one or more controls, such as one or more operator consoles, joysticks, pedals, levers, buttons, switches, steering, and so on. The controls are adapted to control an operation of the machine 100 on a work surface 106. It should be noted that, in many situations, the machine 100 may be an autonomous machine, a semi-autonomous machine, a remotely operated machine, a remotely supervised machine, and so on, based on application requirements.

The machine 100 also includes an enclosure 108 provided on the chassis 102. The enclosure 108 encloses a power source (not shown) mounted on the chassis 102. The power source provides power to the machine 100 for mobility and operational requirements. The power source may include, but not limited to, a diesel engine, a gasoline engine, a gaseous fuel powered engine, a dual fuel powered engine, an electric motor, a fuel cell, a battery, and/or a combination thereof, based on application requirements. Additionally, the machine 100 may include components and/or systems (not shown), such as a fuel delivery system, an air delivery system, a lubrication system, a propulsion system, a drivetrain, a drive control system, a machine control system, and so on, based on application requirements.

The machine 100 also includes a set of ground engaging members 110 (only one ground engaging member shown in the accompanying figure). The ground engaging members 110 are operably coupled to the chassis 102. In the illustrated embodiment, the ground engaging members 110 are tracks. In other embodiments, the ground engaging members 110 may be wheels. The ground engaging members 110 support and provide mobility to the machine 100 on the work surface 106. As such, the ground engaging members 110 provide movement, turning, positioning, and travel of the machine 100 on the work surface 106.

The machine 100 also includes a drill mast 112 disposed on the chassis 102. The drill mast 112 will be hereinafter interchangeably referred to as the "mast 112". The mast 112 is movable relative to the chassis 102 between a substantially vertical position and a non-vertical position via a mast shift cylinder 116. As such, the mast shift cylinder 116 provides alignment of the mast 112 along a height and a width of the chassis 102. The mast 112 is a linearly extending structure, and in the accompanying figure, is upright, extending along a longitudinal axis X-X'. The mast 112 supports one or more drilling components of the machine 100.

The machine 100 also includes a drill assembly 118. The drill assembly 118 is movably disposed on the mast 112. The drill assembly 118 is adapted for drilling holes, channels, tunnels, openings, and so on into, within, and/or extending into, and/or below, the work surface 106. Accordingly, the drill assembly 118 includes a drill bit 120 and a drill string 122 removably coupled to the drill bit 120. Accordingly, the drill assembly 118 is adapted to drill a borehole 124 into the work surface 106.

The drill string 122 includes one or more columns or pipes 126 interlinked with each other and with the drill bit 120. Each of the pipes 126 of the drill assembly 118 have a hollow and generally cylindrical configuration. The pipes 126 provide extension of the drill bit 120 into the borehole 124. For example, each pipe 126 may be coupled to another pipe 126 by way of a threaded connection (not shown). In other embodiments, the pipes 126 may be interlinked with each other by way of other similar connections, for example, by lock fittings, snap fittings, and so on, based on application requirements. The drill string 122 is slidably coupled with the mast 112 via supporting rails 128 and may be driven by a motor (not shown) to slidably move relative to the mast 112 on the supporting rails 128 along the longitudinal axis X-X'.

The drill assembly 118 also includes a carousel 130. The carousel 130 may store and support one or more pipes 126 of the drill assembly 118 when the drill assembly 118 or the drill string 122 is not in use. In one example, the carousel 130 includes a plurality of slots (not shown) adapted to hold the pipes 126. The carousel 130 may also be used to add pipes 126 to the drill assembly 118 to form the drill string 122 when in use. Additionally, the mast 112 and the drill assembly 118 may include one or more components and systems (not shown), such as a drive mechanism including a motor, a chain, a sprocket, and so on; a rotary mechanism; actuators; adapters; guiding members; valves; sensors; controllers; and so on, based on application requirements.

The machine 100 also includes a deck frame 132 disposed on the chassis 102 and in association with the mast 112. The deck frame 132 provides an operating surface on the machine 100. As such, the deck frame 132 may provide the operating surface for an operator to move around the machine 100 or be stationed on the machine 100, to support one or more components of the machine 100, and so on.

Figure 2:
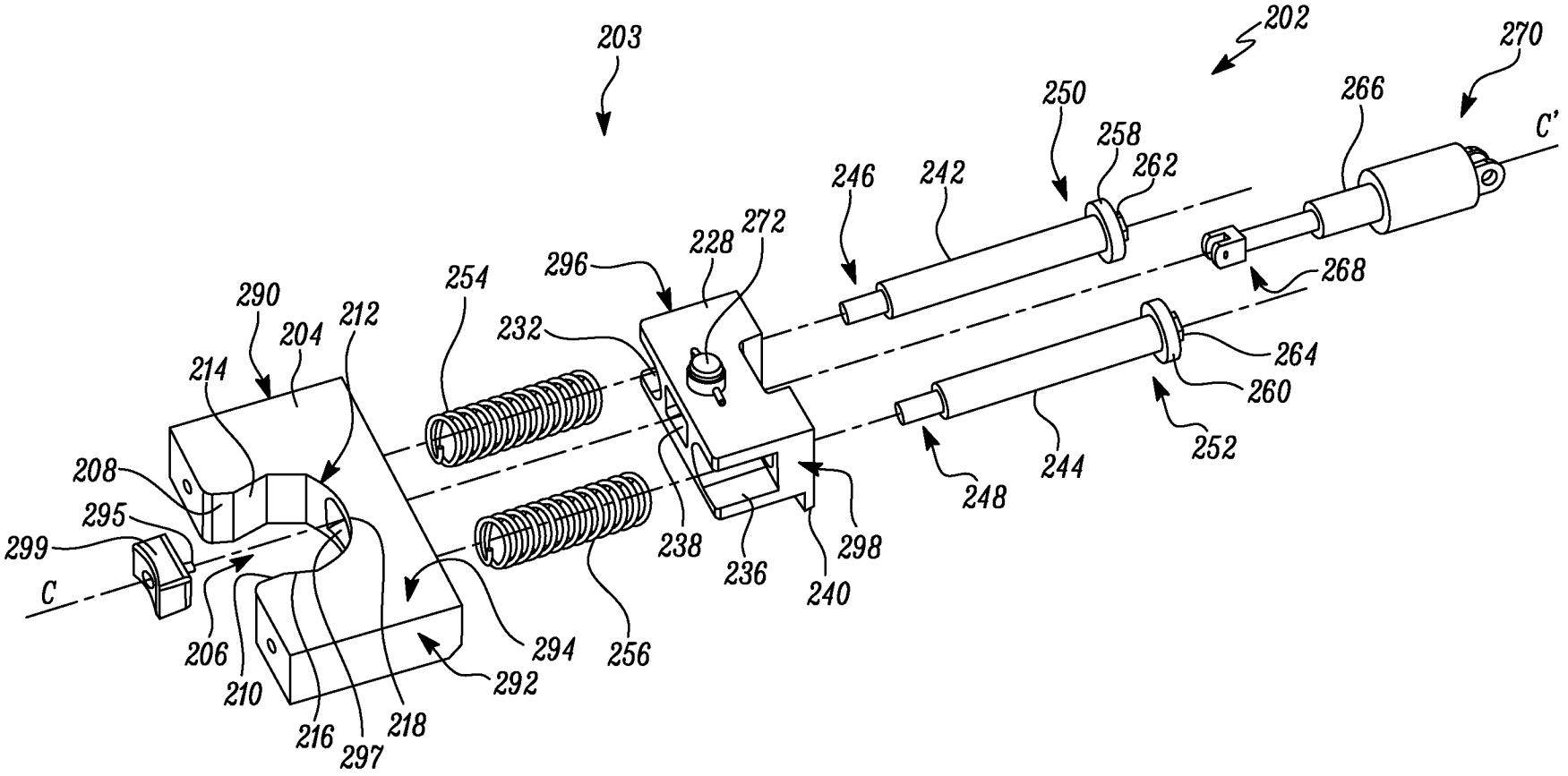
FIG. 2 is an exploded perspective view of the torque wrench engagement mechanism, according to one embodiment of the present disclosure.
Figure 3:
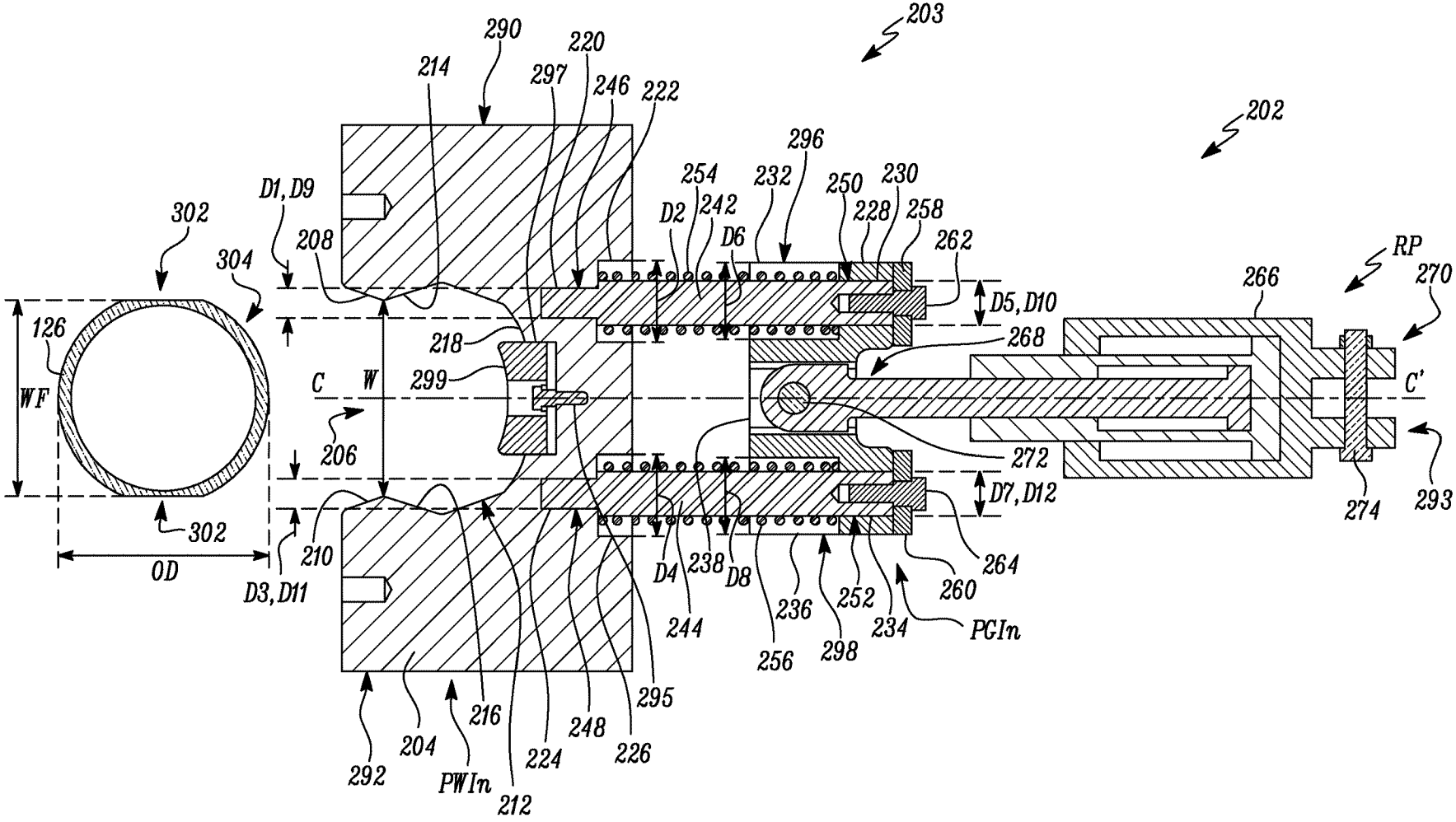
FIG. 3 is an assembled cross-sectional view of the torque wrench engagement mechanism, according to one embodiment of the present disclosure.

Referring to FIG. 1B, the present disclosure relates to a torque wrench engagement mechanism 202 for the machine 100. The torque wrench engagement mechanism 202 is adapted to be disposed on the deck frame 132. Referring to FIGS. 2 and 3, different views of the torque wrench engagement mechanism 202 are illustrated. The torque wrench engagement mechanism 202 will be hereinafter interchangeably referred to as the "mechanism 202". The mechanism 202 is adapted to grip a portion of the pipe 126, such as during removal of the pipe 126 from the drill string 122 or coupling of the pipe 126 to the drill string 122, and so on, based on application requirements. The mechanism 202 includes a wrench assembly 203. The wrench assembly 203 will be hereinafter interchangeably referred to as the "assembly 203".

The assembly 203 includes a wrench member 204. The wrench member 204 will be hereinafter interchangeably referred to as the "wrench 204". The wrench 204 is adapted to receive a flattened portion 302 of the pipe 126. The wrench 204 defines a central axis C-C' of the mechanism 202. In the illustrated embodiment, the wrench 204 has a substantially rectangular configuration. In other embodiments, the wrench 204 may have any other configuration, such as a curved configuration, a triangular configuration, a trapezoidal configuration, and so on, based on application requirements. The wrench 204 may be manufactured using any metal or alloy, such as steel. Also, the wrench 204 may be manufactured using any process, such as forging, casting, fabrication, additive manufacturing, and so on, based on application requirements.

The wrench 204 includes a receiving portion 206 defining a width "W". In the illustrated embodiment, the receiving portion 206 has a partially angled and a partially curved configuration. In other embodiments, the receiving portion 206 may have any other configuration, such as a substantially angled configuration, a substantially curved configuration, and so on, based on application requirements. Accordingly, the receiving portion 206 includes two outer edges 208, 210 and an inner surface 212. The inner surface 212 extends between each of the two outer edges 208, 210. The inner surface 212 includes an angled surface 214 extending from the outer edge 208, and an angled surface 216 extending from the outer edge 210. The inner surface 212 also includes a curved surface 218 extending between each of the angled surfaces 214, 216. The receiving portion 206 is adapted to receive the flattened portion 302 of the pipe 126. Accordingly, the width "W" of the receiving portion 206 is greater than a width "WF" of the flattened portion 302 of the pipe 126. Also, the width "W" of the receiving portion 206 is smaller than an outer diameter "OD" of an outer surface 304 of the pipe 126.

The wrench 204 also includes a first wrench bore 220 and a first wrench recess 222. The first wrench recess 222 is disposed adjacent to and axially aligned with the first wrench bore 220. Also, each of the first wrench bore 220 and the first wrench recess 222 is disposed substantially parallel to the central axis C-C'. A diameter "D1" of the first wrench bore 220 is substantially smaller than a diameter "D2" of the first wrench recess 222. The wrench 204 further includes a second wrench bore 224 and a second wrench recess 226. The second wrench recess 226 is disposed adjacent to and axially aligned with the second wrench bore 224. Also, each of the second wrench bore 224 and the second wrench recess 226 is disposed substantially parallel to the central axis C-C' and each of the first wrench bore 220 and the first wrench recess 222. A diameter "D3" of the second wrench bore 224 is substantially smaller than a diameter "D4" of the second wrench recess 226.

The assembly 203 also includes a guide member 228. The guide member 228 will be hereinafter interchangeably referred to as the "guide 228". The guide 228 is disposed adjacent to the wrench 204 and axially aligned relative to the central axis C-C'. In the illustrated embodiment, the guide 228 has a substantially hollow and rectangular configuration. In other embodiments, the guide 228 may have any other configuration, such as a curved configuration, a trapezoidal configuration, and so on, based on application requirements. The guide 228 may be manufactured using any metal or alloy, such as steel. Also, the guide 228 may be manufactured using any process, such as forging, casting, fabrication, additive manufacturing, and so on, based on application requirements.

The guide 228 also includes a first guide bore 230 and a first guide recess 232. The first guide recess 232 is disposed adjacent to and axially aligned with the first guide bore 230. Also, each of the first guide bore 230 and the first guide recess 232 is disposed substantially parallel to the central axis C-C'. A diameter "D5" of the first guide bore 230 is substantially smaller than a diameter "D6" of the first guide recess 232. The guide 228 further includes a second guide bore 234 and a second guide recess 236. The second guide recess 236 is disposed adjacent to and axially aligned with the second guide bore 234. Also, each of the second guide bore 234 and the second guide recess 236 is disposed substantially parallel to the central axis C-C' and each of the first guide bore 230 and the first guide recess 232. A diameter "D7" of the second guide bore 234 is substantially smaller than a diameter "D8" of the second guide recess 236.

The guide 228 also includes a central bore 238. The central bore 238 is disposed spaced between each of the first guide bore 230 or the first guide recess 232, and the second guide bore 234 or the second guide recess 236. The central bore 238 is axially aligned with the central axis C-C'. As such, the central bore 238 is substantially parallel to each of the first guide bore 230, the first guide recess 232, the second guide bore 234, and the second guide recess 236. The guide 228 further includes a protrusion 240 extending therefrom. In an assembled position of the mechanism 202, the protrusion 240 is adapted to contact the deck frame 132. In the illustrated embodiment, the guide 228 includes a single protrusion 240. In other embodiments, the guide 228 may include multiple protrusions, based on application requirements. In such a situation, each of the multiple protrusions may be disposed spaced apart from one another.

The assembly 203 also includes at least one guide pin, such as a first guide pin 242 and a second guide pin 244. In the illustrated embodiment, the assembly 203 includes two guide pins. In other embodiments, the assembly 203 may include single or multiple guide pins, based on application requirements. In the illustrated embodiment, each of the first guide pin 242 and the second guide pin 244 has a substantially elongated and cylindrical configuration. In other embodiments, one or more of the first guide pin 242 and the second guide pin 244 may have any other configuration, such as a rectangular configuration, an elliptical configuration, and so on, based on application requirements. Each of the first guide pin 242 and the second guide pin 244 may be manufactured using any metal or alloy, such as steel. Also, each of the first guide pin 242 and the second guide pin 244 may be manufactured using any process, such as forging, casting, fabrication, additive manufacturing, and so on, based on application requirements.

Each of the first guide pin 242 and the second guide pin 244 is disposed between the wrench member 204 and the guide member 228. Also, each of the first guide pin 242 and the second guide pin 244 is disposed spaced from one another and the central axis C-C', and substantially parallel to the central axis C-C'. In a situation when the assembly 203 may include a single guide pin (not shown), the single guide pin may be disposed between the wrench member 204 and the guide member 228 and aligned along the central axis C-C'.

Further, each of the first guide pin 242 and the second guide pin 244 includes a first end 246, 248 and a second end 250, 252, respectively. A diameter "D9" of the first end 246 of the first guide pin 242 is substantially smaller than a diameter "D10" of the second end 250 of the first guide pin 242. In the assembled position of the mechanism 202, the first end 246 of the first guide pin 242 is adapted to be received in the first wrench bore 220 of the wrench 204. As such, the diameter "D9" of the first end 246 is approximately equal to the diameter "D1" of the first wrench bore 220.

The second end 250 of the first guide pin 242 is adapted to be received in the first guide bore 230 of the guide 228. As such, the diameter "D10" of the second end 250 is approximately equal to the diameter "D5" of the first guide bore 230. Also, a diameter "D11" of the first end 248 of the second guide pin 244 is substantially smaller than a diameter "D12" of the second end 252 of the second guide pin 244. In the assembled position of the mechanism 202, the first end 248 of the second guide pin 244 is adapted to be received in the second wrench bore 224 of the wrench 204. As such, the diameter "D11" of the first end 248 is approximately equal to the diameter "D3" of the second wrench bore 224. Further, the second end 252 of the second guide pin 244 is adapted to be received in the second guide bore 234 of the guide 228. As such, the diameter "D12" of the second end 252 is approximately equal to the diameter "D7" of the second guide bore 234.

The assembly 203 also includes a spring member, such as a first spring member 254 and a second spring member 256, disposed in association with the at least one guide pin, respectively. Each of the first spring member 254 and the second spring member 256 is disposed between the wrench member 204 and the guide member 228. The first spring member 254 will be hereinafter interchangeably referred to as the "first spring 254". The second spring member 256 will be hereinafter interchangeably referred to as the "second spring 256".

In the assembled position of the mechanism 202, the first spring 254 is disposed around the first guide pin 242 and within each of the first wrench recess 222 and the first guide recess 232. Also, the second spring member 256 is disposed around the second guide pin 244 and within each of the second wrench recess 226 and the second guide recess 236. Accordingly, each of the first spring 254 and the second spring 256 is adapted to bias the wrench 204 and the guide 228 away from one another along the central axis C-C'. In a situation when the assembly 203 may include the single guide pin, the assembly 203 may include a single spring member (not shown) disposed between the wrench member 204 and the guide member 228 and around the single guide pin.

The assembly 203 also includes a washer member, such as a first washer member 258 and a second washer member 260, disposed in association with the at least one guide pin and the guide member 228. The first washer member 258 will be hereinafter interchangeably referred to as the "first washer 258". The second washer member 260 will be hereinafter interchangeably referred to as the "second washer 260". In the assembled position of the mechanism 202, the first washer 258 is disposed on the second end 250 of the first guide pin 242 and adjacent to the first guide bore 230 of the guide 228. Also, the second washer member 260 is disposed on the second end 252 of the second guide pin 244 and adjacent to the second guide bore 234 of the guide 228.

The first washer 258 is removably coupled to the second end 250 of the first guide pin 242 using a first fastener 262. The second washer 260 is removably coupled to the second end 252 of the second guide pin 244 using a second fastener 264. Each of the first washer 258 and the second washer 260 may be manufactured using any material, such as a metal, an alloy, a polymer, rubber, a combination thereof, and so on, based on application requirements. Also, each of the first washer 258 and the second washer 260 may be manufactured using any process, such as a stamping, molding, extrusion, fabrication, additive manufacturing, and so on, based on application requirements.

The mechanism 202 also includes an actuation member 266 operably coupled to the assembly 203. More specifically, the actuation member 266 is disposed between the guide member 228 and a fixed end 293 on the machine 100. In the illustrated embodiment, the fixed end 293 is disposed on the deck frame 132. In other embodiments, the fixed end 293 may be disposed on any other location on the machine 100. Also, the actuation member 266 is axially aligned along the central axis C-C'. In the illustrated embodiment, the actuation member 266 is a fluid powered actuator, such as a hydraulic actuator, a pneumatic actuator, and so on.

In other embodiments, the actuation member 266 may be any other actuator, such as an electrically powered actuator, a magnetically powered actuator, and so on, based on application requirements. Accordingly, the actuation member 266 includes a rod end 268 and a cylinder end 270. The rod end 268 is removably coupled to the guide 228. More specifically, the rod end 268 is received within the central bore 238 of the guide 228 and removably coupled to the guide 228 using a rod pin 272. The cylinder end 270 is removably coupled to the fixed end 293 of the deck frame 132 using a cylinder fastener 274.

The actuation member 266 is adapted to move between a retracted position "RP", an intermediate position "IP", and an extended position "EP" along the central axis C-C'. Based on movement of the actuation member 266, each of the wrench 204 and the guide 228 is adapted to slidably move along the central axis C-C' to receive the flattened portion 302 of the pipe 126 in the receiving portion 206 of the wrench 204. Each of the retracted position "RP", the intermediate position "IP", and the extended position "EP" of the actuation member 266 will be explained in more detail later.

The assembly 203 further includes a damper member 299. The damper member 299 will be hereinafter interchangeably referred to as the "damper 299". The damper 299 is disposed in the receiving portion 206 of the wrench member 204. More specifically, the damper 299 is removably disposed in a central cavity 297 provided in the receiving portion 206 of the wrench 204. The damper 299 is removably coupled to the wrench 204 using a fastener 295. The damper 299 is adapted to dampen contact between the inner surface 212 of the receiving portion 206 of the wrench 204 and the outer surface 304 of the pipe 126. As such, the damper 299 may be made of any resilient material, such as rubber, elastomer, and so on. In the illustrated embodiment, the assembly 203 includes a single damper 299. In other embodiments, the assembly 203 may include multiple dampers, based on application requirements. In such a situation, each of the multiple dampers may be disposed spaced apart from one another in the receiving portion 206 of the wrench 204.

Figure 4:
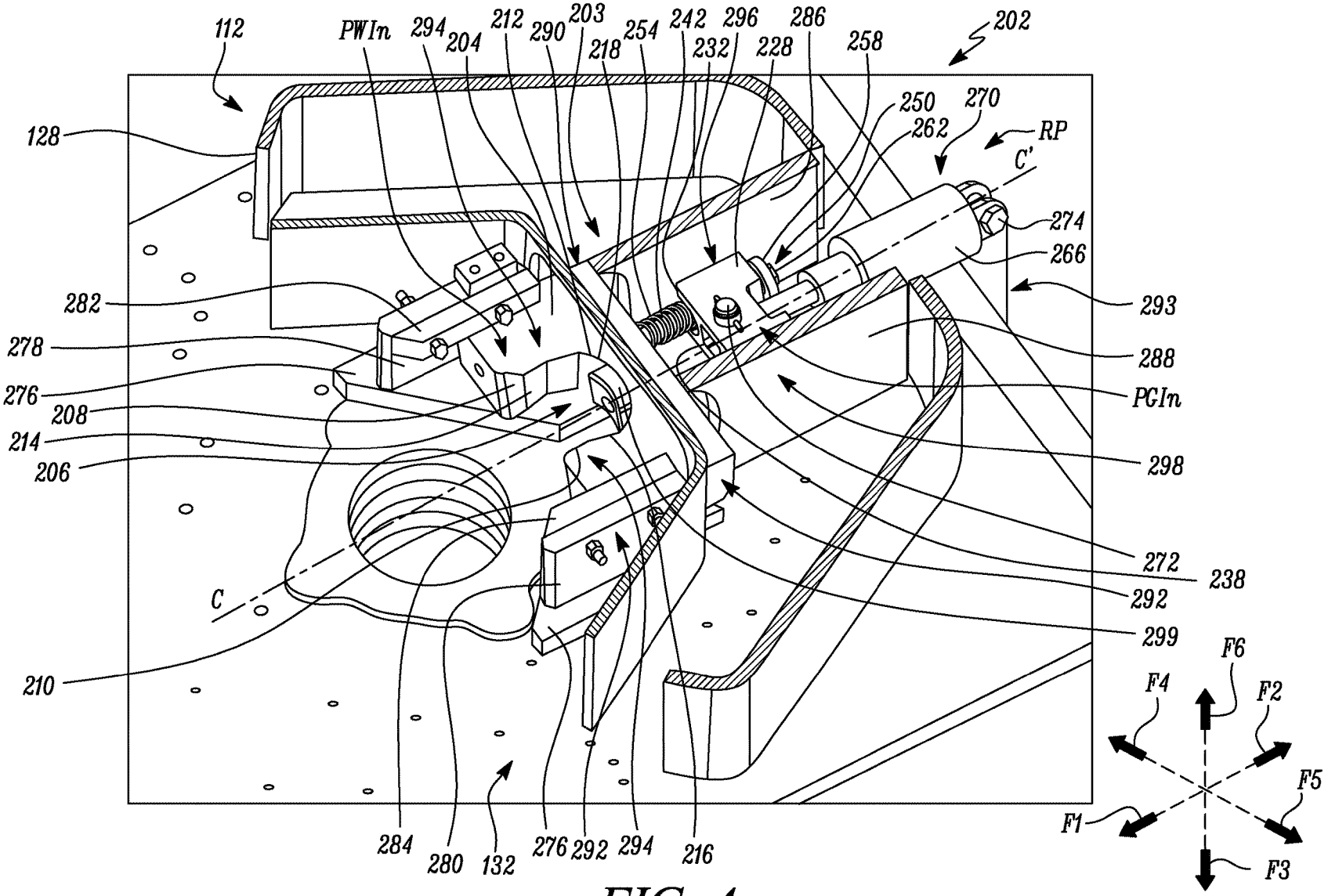
FIG. 4 is a perspective view of the torque wrench engagement mechanism assembled on the drilling machine, according to one embodiment of the present disclosure.

Referring to FIG. 4, the mechanism 202 also includes a number of guide elements, such as at least one first guide element 276, a second guide element 278, a third guide element 280, a fourth guide element 282, a fifth guide element 284, a sixth guide element 286, and a seventh guide element 288. The first guide element 276 will be hereinafter interchangeably referred to as the "first element 276". The second guide element 278 will be hereinafter interchangeably referred to as the "second element 278". The third guide element 280 will be hereinafter interchangeably referred to as the "third element 280". The fourth guide element 282 will be hereinafter interchangeably referred to as the "fourth element 282". The fifth guide element 284 will be hereinafter interchangeably referred to as the "fifth element 284". The sixth guide element 286 will be hereinafter interchangeably referred to as the "sixth element 286". The seventh guide element 288 will be hereinafter interchangeably referred to as the "seventh element 288".

The first element 276 is disposed between the deck frame 132 and the wrench 204. As such, the first element 276 is adapted to provide a sliding surface and/or a guiding surface for the wrench 204 during movement of the wrench 204 between an initial position "PWIn", a first position "PW1", and a second position "PW2". Also, the first element 276 is adapted to limit movement of the wrench 204 in a direction "F3" perpendicular to the central axis C-C' during movement of the wrench 204 between the initial position "PWIn", the first position "PW1", and the second position "PW2". In the illustrated embodiment, the mechanism 202 includes a single first element 276. In other embodiments, the mechanism 202 may include multiple first elements disposed adjacent to one another.

The second element 278 is disposed adjacent to a first side 290 of the wrench member 204. As such, the second element 278 is adapted to provide a sliding surface and/or a guiding surface for the first side 290 of the wrench 204 during movement of the wrench 204 between the initial position "PWIn", the first position "PW1", and the second position "PW2". Also, the second element 278 is adapted to limit movement of the wrench 204 in a direction "F4" perpendicular to the central axis C-C' during movement of the wrench 204 between the initial position "PWIn", the first position "PW1", and the second position "PW2". In the illustrated embodiment, the second element 278 is coupled to the first element 276 and disposed substantially perpendicular to the first element 276. In other embodiments, the second element 278 may be disposed on the deck frame 132. Also, the second element 278 may be disposed in any orientation relative to the first element 276 or the deck frame 132, based on application requirements.

The third element 280 is disposed adjacent to a second side 292 of the wrench member 204. The second side 292 is disposed opposite to the first side 290. As such, the third element 280 is adapted to provide a sliding surface and/or a guiding surface for the second side 292 of the wrench 204 during movement of the wrench 204 between the initial position "PWIn", the first position "PW1", and the second position "PW2". Also, the third element 280 is adapted to limit movement of the wrench 204 in a direction "F5" perpendicular to the central axis C-C' during movement of the wrench 204 between the initial position "PWIn", the first position "PW1", and the second position "PW2". In the illustrated embodiment, the third element 280 is coupled to the first element 276 and disposed substantially perpendicular to the first element 276. In other embodiments, the third element 280 may be disposed on the deck frame 132. Also, the third element 280 may be disposed in any orientation relative to the first element 276 or the deck frame 132, based on application requirements.

The fourth element 282 is disposed adjacent to the second element 278 and a third side 294 of the wrench member 204. The third side 294 extends between each of the first side 290 and the second side 292. As such, the fourth element 282 is adapted to provide a sliding surface and/or a guiding surface for the third side 294 of the wrench 204 during movement of the wrench 204 between the initial position "PWIn", the first position "PW1", and the second position "PW2". Also, the fourth element 282 is adapted to limit movement of the wrench 204 in a direction "F6" perpendicular to the central axis C-C' during movement of the wrench 204 between the initial position "PWIn", the first position "PW1", and the second position "PW2". The fourth element 282 is coupled to the second element 278 and disposed substantially perpendicular to the second element 278. In other embodiments, the fourth element 282 may be disposed in any orientation relative to the second element 278, based on application requirements.

The fifth element 284 is disposed adjacent to the third element 280 and the third side 294 of the wrench member 204. As such, the fifth element 284 is adapted to provide a sliding surface and/or a guiding surface for the third side 294 of the wrench 204 during movement of the wrench 204 between the initial position "PWIn", the first position "PW1", and the second position "PW2". Also, the fifth element 284 is adapted to limit movement of the wrench 204 in the direction "F6" perpendicular to the central axis C-C' during movement of the wrench 204 between the initial position "PWIn", the first position "PW1", and the second position "PW2". The fifth element 284 is coupled to the third element 280 and disposed substantially perpendicular to the third element 280. In other embodiments, the fifth element 284 may be disposed in any orientation relative to the third element 280, based on application requirements.

The sixth element 286 is disposed adjacent to a first side 296 of the guide member 228. As such, the sixth element 286 is adapted to provide a sliding surface and/or a guiding surface for the first side 296 of the guide 228 during movement of the guide 228 between an initial position "PGIn", a first position "PG1", and a second position "PG2". Also, the sixth element 286 is adapted to limit movement of the guide 228 in the direction "F4" perpendicular to the central axis C-C' during movement of the guide 228 between the initial position "PGIn", the first position "PG1", and the second position "PG2". The sixth element 286 is coupled to the deck frame 132 and disposed substantially perpendicular to the deck frame 132. In other embodiments, the sixth element 286 may be disposed in any orientation relative to the deck frame 132, based on application requirements.

The seventh element 288 is disposed adjacent to a second side 298 of the guide member 228. The second side 298 is disposed opposite to the first side 296. As such, the seventh element 288 is adapted to provide a sliding surface and/or a guiding surface for the second side 298 of the guide 228 during movement of the guide 228 between the initial position "PGIn", the first position "PG1", and the second position "PG2". Also, the seventh element 288 is adapted to limit movement of the guide 228 in the direction "F5" perpendicular to the central axis C-C' during movement of the guide 228 between the initial position "PGIn", the first position "PG1", and the second position "PG2". The seventh element 288 is coupled to the deck frame 132 and disposed substantially perpendicular to the deck frame 132. In other embodiments, the seventh element 288 may be disposed in any orientation relative to the deck frame 132, based on application requirements.

Each of the first element 276, the second element 278, the third element 280, the fourth element 282, the fifth element 284, the sixth element 286, and the seventh element 288 may be manufactured using any material, such as a metal, an alloy, a polymer, a combination thereof, and so on, based on application requirements. Also, each of the first element 276, the second element 278, the third element 280, the fourth element 282, the fifth element 284, the sixth element 286, and the seventh element 288 may be manufactured using any process, such as casting, forging, fabrication, stamping, and so on, based on application requirements.

Figure 5:
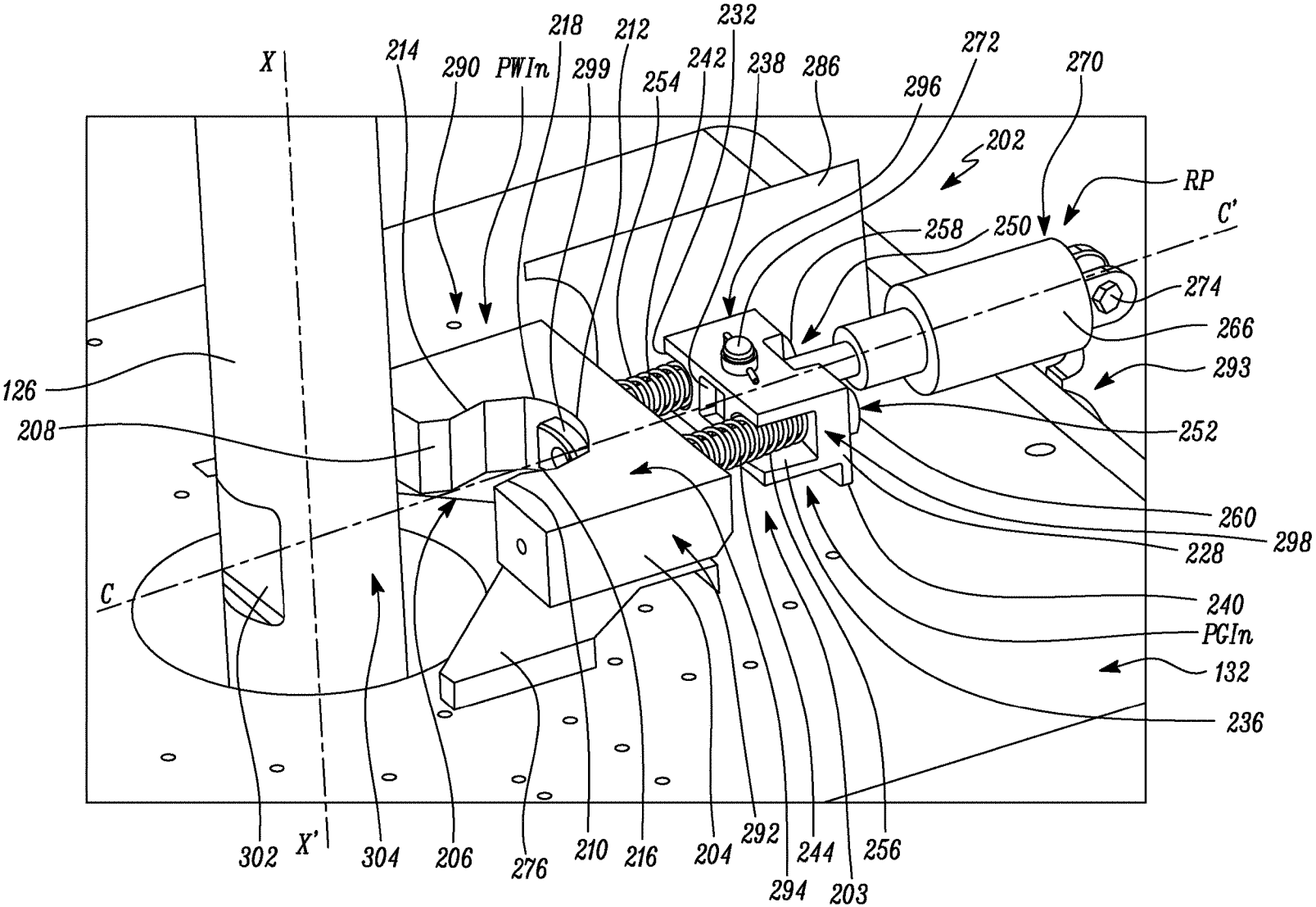
FIGS. 5 to 8 show different operating positions of the torque wrench engagement mechanism, according to one embodiment of the present disclosure.

Referring to FIG. 5, in the retracted position "RP" of the actuation member 266, each of the wrench 204 and the guide 228 is disposed in the initial position "PWIn, PGIn", respectively. In the initial position "PWIn", the wrench 204 is disposed away from the pipe 126. Also, in the initial position "PGIn", the guide 228 is biased away from the wrench 204 based on extension of each of the first spring member 254 and the second spring member 256.

Figure 6:
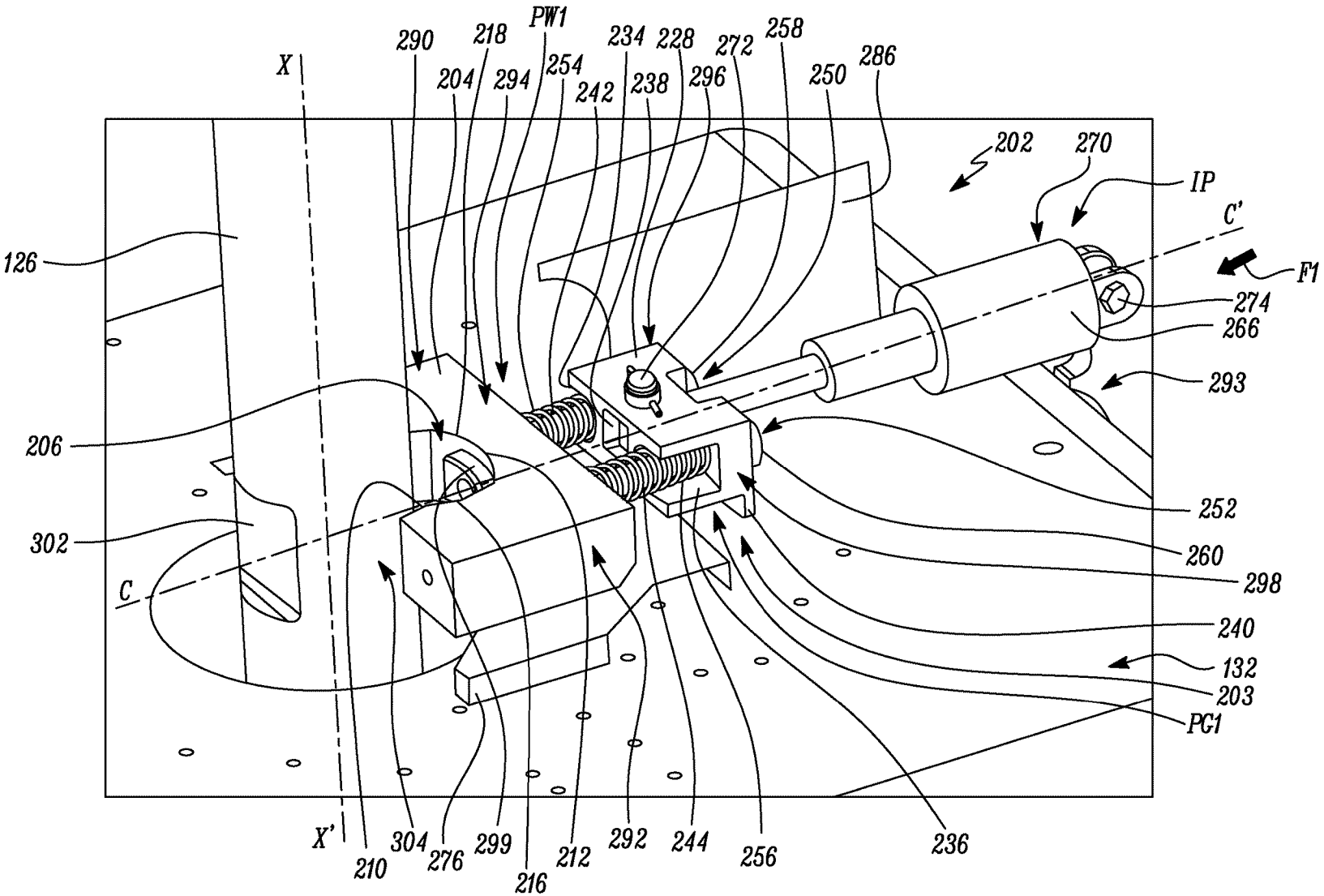

Referring to FIG. 6, in the intermediate position "IP" of the actuation member 266, each of the wrench 204 and the guide 228 is moved in the first position "PW1, PG1" from the initial position "PWIn, PGIn", respectively, along the central axis C-C' in a direction "F1". In the first position "PW1", the wrench 204 is disposed adjacent to the pipe 126, such that the outer edges 208, 210 of the receiving portion 206 contact the outer surface 304 of the pipe 126. In the first position "PG1", the guide 228 is biased away from the wrench 204 based on extension of each of the first spring member 254 and the second spring member 256.

Figure 7:
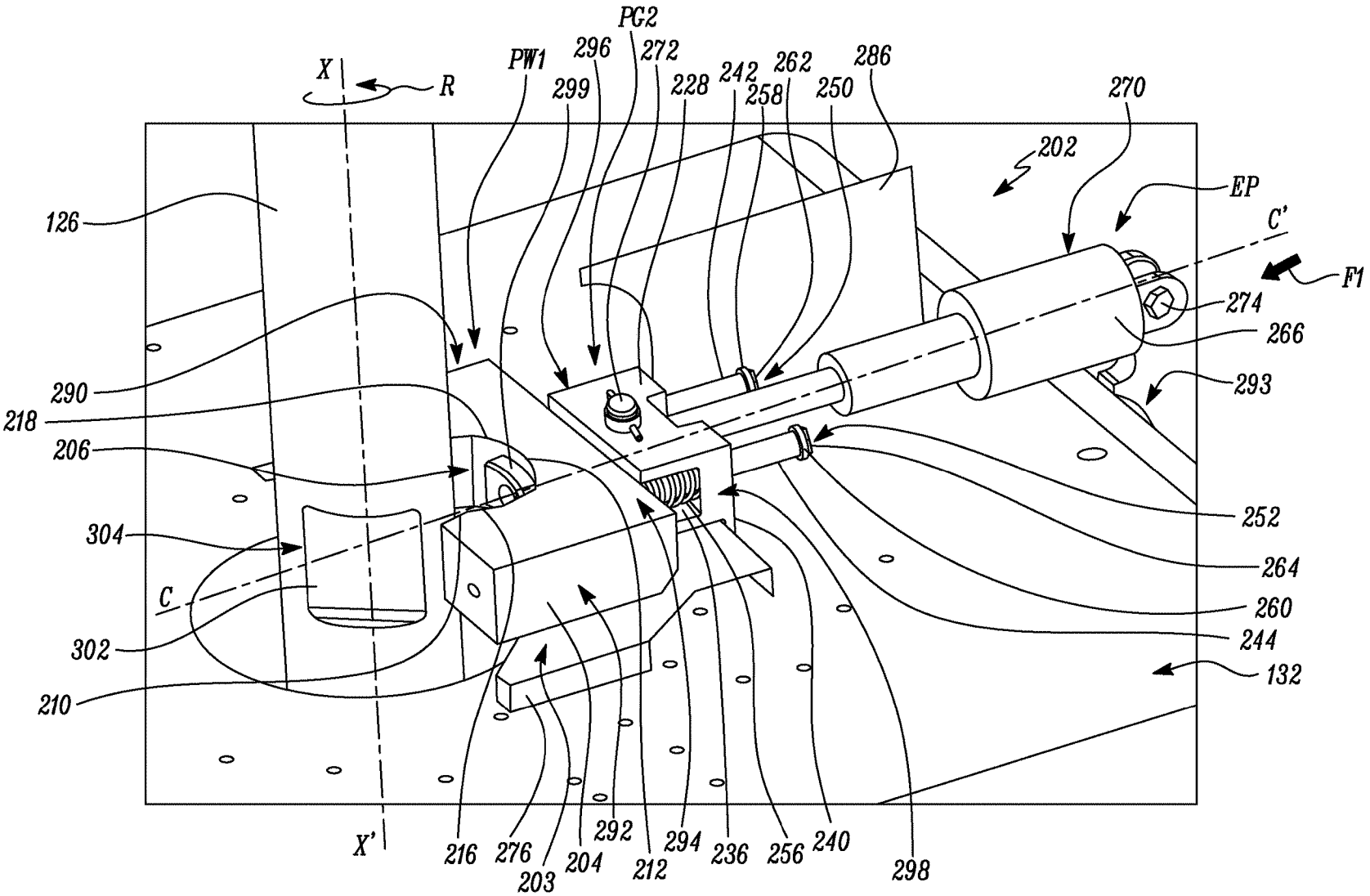

Referring to FIG. 7, in the extended position "EP" of the actuation member 266, the guide 228 is moved in the second position "PG2" from the first position "PG1" along the central axis C-C' in the direction "F1". In the second position "PG2", the guide 228 is disposed adjacent to the wrench 204 based on compression of each of the first spring member 254 and the second spring member 256. As such, the guide 228 is adapted to slidably move along the at least one guide pin, such as the first guide pin 242 and the second guide pin 244, based on movement of the actuation member 266 between the intermediate position "IP" and the extended position "EP".

Figure 8:
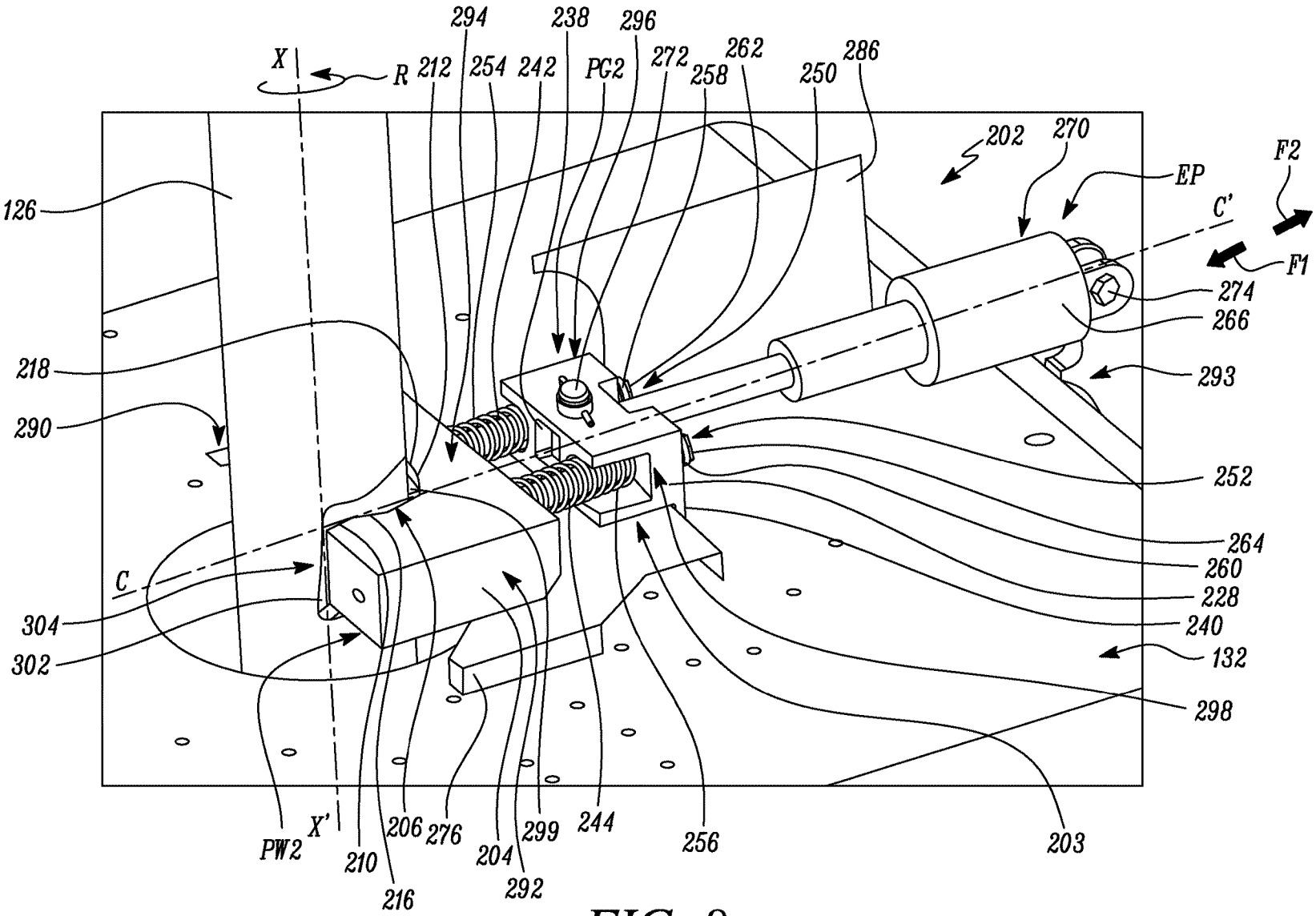

Referring to FIG. 8, further, based on rotation of the pipe 126 in a direction "R", the flattened portion 302 of the pipe 126 contacts the outer edges 208, 210 of the receiving portion 206 and aligns with the receiving portion 206 of the wrench 204. Accordingly, based on extension of each of the first spring member 254 and the second spring member 256, the wrench 204 is biased in the second position "PW2" from the first position "PW1" away from the guide 228 along the central axis C-C' in the direction "F1". As such, in the second position "PW2", the flattened portion 302 of the pipe 126 is received in the receiving portion 206 of the wrench 204. Accordingly, at the extended position "EP" of the actuation member 266, each of the first spring member 254 and the second spring member 256 is adapted to move the wrench member 204 to engage with the flattened portion 302 of the pipe 126, when the flattened portion 302 of the pipe 126 slidably aligns with the receiving portion 206 of the wrench member 204. It should be noted that the direction "R" of rotation of the pipe 126 is merely exemplary and may vary based on application requirements. The pipe 126 may be rotated using a motor (not shown) operably coupled to the pipe 126 and disposed on the mast 112.

INDUSTRIAL APPLICABILITY

Figure 9:
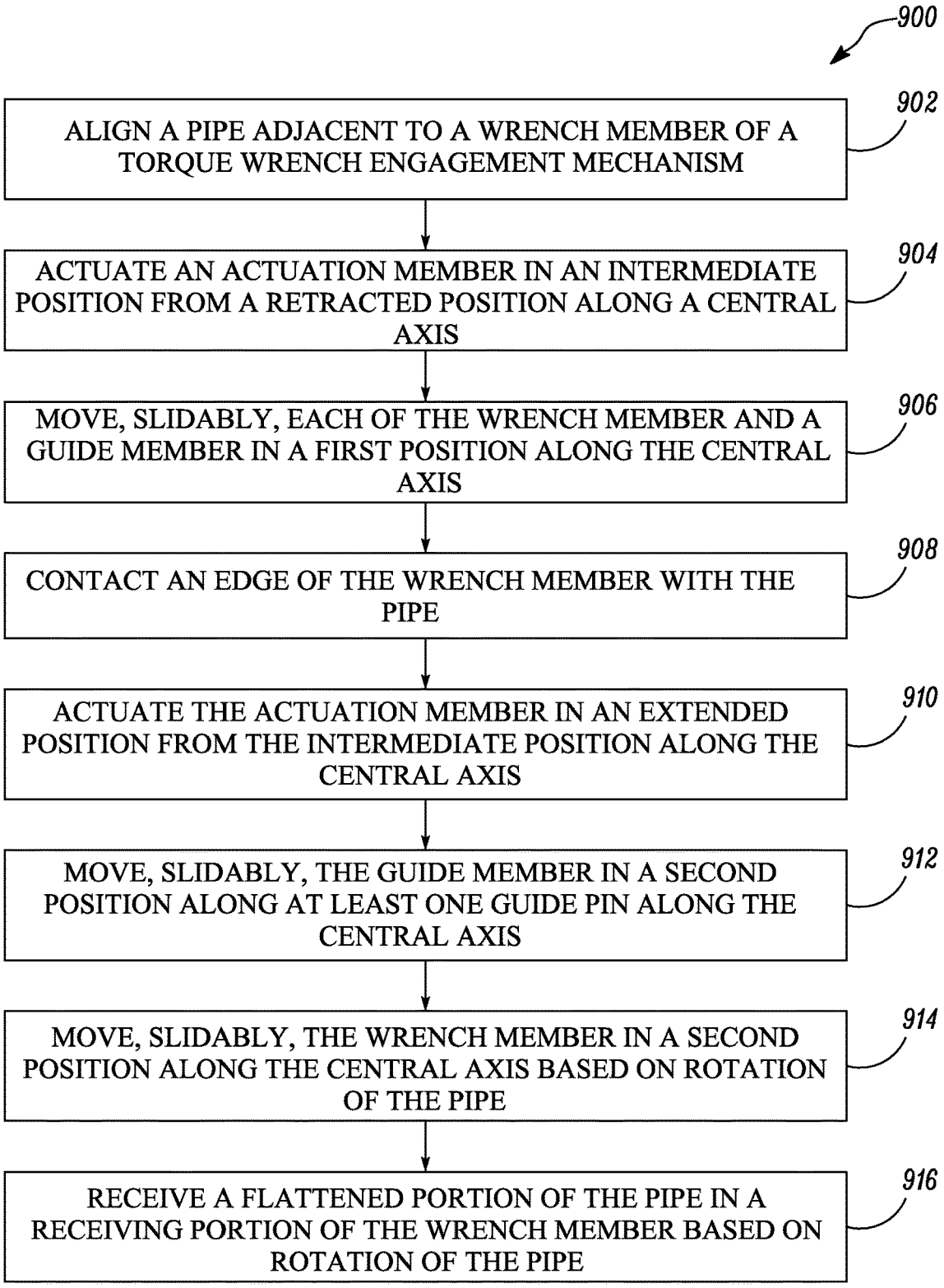
FIG. 9 is a flowchart illustrating a method for engaging a pipe using the torque wrench engagement mechanism, according to one embodiment of the present disclosure.

Referring to FIG. 9, the present disclosure relates to a method 900 for engaging the pipe 126 using the torque wrench engagement mechanism 202. Referring to FIG. 9, a flowchart of the method 900 is illustrated. The method 900 will now be explained with combined references to FIGS. 5 to 9. It should be noted that some elements of the mechanism 202 are omitted in FIGS. 5 to 8 for purpose of clarity and explanation. At step 902, and referring to FIG. 5, the pipe 126 is aligned adjacent to the wrench member 204 of the torque wrench engagement mechanism 202. More specifically, the flattened portion 302 of the pipe 126 is aligned adjacent to the receiving portion 206 of the wrench 204. Also, the actuation member 266 is disposed in the retracted position "RP", such that each of the wrench 204 and the guide 228 is disposed in the initial position "PWIn, PGIn", respectively.

At step 904, and referring to FIG. 6, the actuation member 266 is actuated in the intermediate position "IP" from the retracted position "RP" along the central axis C-C'. Accordingly, at step 906, and still referring to FIG. 6, each of the wrench member 204 and the guide member 228 is slidably moved in the first position "PW1, PG1", respectively, along the central axis C-C'. As such, at step 908, and still referring to FIG. 6, the outer edges 208, 210 of the wrench member 204 contact with the outer surface 304 of the pipe 126.

At step 910, and referring to FIG. 7, the actuation member 266 is actuated in the extended position "EP" from the intermediate position "IP" along the central axis C-C'. Accordingly, at step 912, and still referring to FIG. 7, the guide member 228 is slidably moved in the second position "PG2" along the at least one guide pin along the central axis C-C'. More specifically, during movement of the guide 228 in the second position "PG2" from the first position "PG1", each of the first spring 254 and the second spring 256 is compressed between the wrench member 204 and the guide member 228.

At step 914, and referring to FIG. 8, the wrench member 204 is slidably moved in the second position "PW2" along the central axis C-C' based on rotation of the pipe 126 in the direction "R". More specifically, during movement of the wrench 204 in the second position "PW2" from the first position "PW1", each of the first spring 254 and the second spring 256 is extended between the wrench member 204 and the guide member 228. As such, the wrench 204 is biased away from the guide 228 along the central axis C-C'. Also, the outer edges 208, 210 of the receiving portion 206 of the wrench 204 slide along the flattened portion 302 during movement of the wrench 204 in the second position "PW2" from the first position "PW1".

Accordingly, at step 916, and still referring to FIG. 8, the flattened portion 302 of the pipe 126 is received in the receiving portion 206 of the wrench member 204 based on rotation of the pipe 126. More specifically, in the second position "PW2" of the wrench 204 and based on rotation of the pipe 126, the flattened portion 302 of the pipe 126 contacts one of the angled surfaces 214, 216 of the inner surface 212 of the receiving portion 206 of the wrench 204. As such, the flattened portion 302 of the pipe 126 is completely received in the receiving portion 206 of the wrench 204. Further, during release of the flattened portion 302 of the pipe 126 from the wrench 204, the actuation member 266 may be moved from the extended position "EP" to the retracted position "RP" in a direction "F2" in order to move each of the wrench 204 and the guide 228 in the initial position "PWIn, PGIn" from the second position "PW2, PG2", respectively, in the direction "F2".

Additionally, during movement of the wrench 204 from the first position "PW1" to the second position "PW2", extension of each of the first spring 254 and the second spring 256 forces the wrench 204 away from the guide 228 in order to receive the flattened portion 302 of the pipe 126 in the receiving portion 206 of the wrench 204. As such, the inner surface 212 of the receiving portion 206 may impact on the outer surface 304 of the pipe 126. Accordingly, the damper member 299 disposed in the receiving portion 206 of the wrench 204 dampens contact between the receiving portion 206 of the wrench member 204 and the pipe 126, in turn, providing a relatively soft contact between the wrench 204 and the pipe 126 and limiting damage to each of the wrench 204 and the pipe 126.

During movement of the wrench 204 between the initial position "PWIn", the first position "PW1", and the second position "PW2", each of the first element 276, the second element 278, the third element 280, the fourth element 282, and the fifth element 284 guide 228 the wrench 204 along the central axis C-C' in the direction "F1" and the direction "F2". As such, each of the first element 276, the second element 278, the third element 280, the fourth element 282, and the fifth element 284 provide a smooth and improved sliding movement of the wrench 204 between the first position "PW1" and the second position "PW2".

During movement of the guide 228 between the initial position "PGIn", the first position "PG1", and the second position "PG2", each of the sixth element 286 and the seventh element 288 guide the guide member 228 along the central axis C-C' in the direction "F1" and the direction "F2". As such, each of the sixth element 286 and the seventh element 288 provide a smooth and improved sliding movement of the guide 228 between the first position "PG1" and the second position "PG2". Additionally, the protrusion 240 provided on the guide 228 limits friction between the guide 228 and the deck frame 132, in turn, limiting wear and tear of the guide 228.

The mechanism 202 provides a simple, efficient, and cost-effective method of automatically gripping the flattened portion 302 of the pipe 126. Based on rotation of the pipe 126, the flattened portion 302 of the pipe 126 may be automatically received in the wrench 204, in turn, limiting operator dependence and operator skill for aligning the flattened portion 302 of the pipe 126 with the wrench 204. As such, misalignment of the flattened portion 302 of the pipe 126 with the receiving portion 206 of the wrench 204 may be limited, in turn, limiting damage to the pipe 126 and/or the wrench 204. The mechanism 202, thus, provides reduced operation time during removal and/or coupling of the pipe 126 to the drill string 122, in turn, reducing cycle time, reducing costs, reducing labor effort, reducing operator fatigue, increasing productivity, and so on. The mechanism 202 may be retrofitted on any drilling machine, in turn, improving flexibility and compatibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A torque wrench engagement mechanism, comprising:
a wrench assembly including:
a wrench defining a central axis, the wrench including a receiving portion to receive a flattened portion of a pipe;
a guide adjacent to the wrench and axially aligned relative to the central axis;
at least one guide pin between the wrench and the guide; and
at least one spring in association with the at least one guide pin and between the wrench and the guide, and
an actuator operably coupled to the wrench assembly, the actuator adapted to move between a retracted position, an intermediate position, and an extended position along the central axis,
wherein at the extended position of the actuator, the at least one spring is adapted to move the wrench to engage with the flattened portion of the pipe, when the flattened portion of the pipe slidably aligns with the receiving portion of the wrench,
wherein in the extended position of the actuator the wrench is movable along the central axis away from the actuator from a first position to a second position, and
wherein a first amount of compression of the at least one spring in the first position of the wrench is greater than a second amount of compression of the at least one spring in the second position of the wrench.

2. The torque wrench engagement mechanism of claim 1 further including at least one first guide between a deck frame and the wrench.

3. The torque wrench engagement mechanism of claim 2 further including:
a second guide adjacent to a first side of the wrench, and
a third guide adjacent to a second side of the wrench, the second side being opposite to the first side.

4. The torque wrench engagement mechanism of claim 1, wherein a width of the receiving portion of the wrench is greater than a width of the flattened portion of the pipe and smaller than a width of an outer surface of the pipe.

5. The torque wrench engagement mechanism of claim 1, wherein the at least one guide pin includes a first guide pin and a second guide pin, each of the first guide pin and the second guide pin being spaced from one another and parallel to the central axis.

6. The torque wrench engagement mechanism of claim 1, wherein the guide is adapted to slidably move along the at least one guide pin based on movement of the actuator between the intermediate position and the extended position.

7. The torque wrench engagement mechanism of claim 1 further including a damper disposed in the receiving portion of the wrench.

8. The torque wrench engagement mechanism of claim 1 further including a washer associated with the at least one guide pin and the guide.

9. A drilling machine comprising:
a chassis;
a set of ground engagers operably coupled to the chassis;
a drill mast disposed on the chassis;
a deck frame on the chassis and in association with the drill mast; and
a torque wrench engager on the deck frame, the torque wrench engager including:
a wrench assembly including:
a wrench defining a central axis, the wrench including a receiving portion to receive a flattened portion of a pipe;
a guide adjacent to the wrench and axially aligned relative to the central axis;
at least one guide pin between the wrench and the guide; and
at least one spring in association with the at least one guide pin and between the wrench and the guide such that the wrench is movable along the central axis relative to the guide from a first position to a second position; and
an actuator operably coupled to the wrench, the actuator adapted to move between a retracted position, an intermediate position, and an extended position along the central axis, wherein at the extended position of the actuator, the at least one spring is adapted to move the wrench from the first position to the second position to engage with the flattened portion of the pipe, when the flattened portion of the pipe slidably aligns with the receiving portion of the wrench, and wherein a first amount of compression of the at least one spring in the first position of the wrench is greater than a second amount of compression of the at least one spring in the second position of the wrench.

10. The drilling machine of claim 9 further including at least one first guide between the deck frame and the wrench.

11. The drilling machine of claim 10 further including:

a second guide adjacent to a first side of the wrench; and a third guide adjacent to a second side of the wrench, the second side being opposite to the first side.

12. The drilling machine of claim 9, wherein a width of the receiving portion of the wrench is greater than a width of the flattened portion of the pipe and smaller than a width of an outer surface of the pipe.

13. The drilling machine of claim 9, wherein the at least one guide pin includes a first guide pin and a second guide pin, each of the first guide pin and the second guide pin being spaced from one another and parallel to the central axis.

14. The drilling machine of claim 9, wherein the guide is adapted to slidably move along the at least one guide pin based on movement of the actuator between the intermediate position and the extended position.

15. The drilling machine of claim 9 further including a damper in the receiving portion of the wrench.

16. The drilling machine of claim 9 further including a washer associated with the at least one guide pin and the guide.

17. A method for engaging a pipe using a torque wrench engager, the method comprising:

aligning the pipe adjacent to a wrench of the torque wrench engager;

actuating an actuator to an intermediate position from a retracted position along a central axis;

moving, slidably, each of the wrench and a guide to a first position along the central axis;

contacting opposite edges of the wrench with the pipe;

actuating the actuator to an extended position from the intermediate position along the central axis;

moving, slidably, the guide to a second position along at least one guide pin along the central axis;

moving, slidably, the wrench relative to the guide to a second position along the central axis based on rotation of the pipe; and receiving a flattened portion of the pipe in a receiving portion of the wrench based on rotation of the pipe, wherein in the extended position of the actuator the wrench is movable along the central axis away from the actuator from the first position to the second position, wherein a first amount of compression of at least one spring in the first position of the wrench is greater than a second amount of compression of the at least one spring in the second position of the wrench, and wherein the at least one spring is in association with the at least one guide pin and between the wrench and the guide such that the wrench is movable along the central axis relative to the guide from the first position to the second position.

18. The method of claim 17, wherein said moving the guide to the second position further includes compressing the one or more springs between the wrench and the guide.

19. The method of claim 18, wherein said moving the wrench to the second position further includes extending the one or more springs between the wrench and the guide.

20. The method of claim 17, wherein said receiving the flattened portion of the pipe further includes damping contact between the receiving portion of the wrench and the pipe using a damper.

* * * * *